United States Patent [19]

Poister

[11] 4,059,857

[45] Nov. 29, 1977

[54] FREE STANDING TOILET STOOL VENTILATING DEVICE

[76] Inventor: Clarence E. Poister, 2934 Lydia, Apt. 103, Topeka, Kans. 66614

[21] Appl. No.: 752,470

[22] Filed: Dec. 20, 1976

[51] Int. Cl.[2] ..... A47K 3/22; E03D 9/04; E03D 13/00

[52] U.S. Cl. ..... 4/213; 4/214; 4/215; 4/72

[58] Field of Search ..... 4/213, 214, 215, 216, 4/218, 209, 72

[56] References Cited

U.S. PATENT DOCUMENTS

| | | | |
|---|---|---|---|
| 2,846,696 | 8/1958 | Harriott | 4/213 |
| 3,059,245 | 10/1962 | Bell | 4/213 |
| 3,230,551 | 1/1966 | Kopp | 4/213 |
| 3,366,979 | 2/1968 | Johnston | 4/213 |
| 3,571,824 | 3/1971 | Poister | 4/213 |
| 3,824,637 | 7/1974 | Hunnicutt, Jr. | 4/213 |
| 3,857,119 | 12/1974 | Hunnicutt, Jr. | 4/213 |
| 3,869,737 | 3/1975 | Stevenson | 4/213 |
| 3,887,948 | 6/1975 | Stamper | 4/213 |
| 3,927,429 | 12/1975 | Pearson | 4/213 |

*Primary Examiner*—Henry K. Artis
*Attorney, Agent, or Firm*—Edwin H. Crabtree; John H. Widdowson

[57] ABSTRACT

A free standing toilet stool ventilating device for placing adjacent a toilet and ventilating fumes therefrom. The device having a reversible pivotable air inlet arm disposed between the top of the toilet bowl and the bottom of the toilet seat. The device providing an electric blower and charcoal filter for filtering the fumes. The housing further including a water overflow chamber with a floating ball valve for receiving overflow water from the toilet and discharging it therefrom to prevent water from contacting the filter and electric blower.

9 Claims, 10 Drawing Figures

FREE STANDING TOILET STOOL VENTILATING DEVICE

BACKGROUND OF THE INVENTION

This invention relates generally to toilet ventilating devices and more particularly, but not by way of limitation, to a free standing toilet stool ventilating device for mounting adjacent either side of a toilet bowl.

Heretofore, there have been various types to toilet ventilating devices for mounting to the toilet bowl or between the top of the toilet bowl and toilet bowl seat. These devices include various types and designs of fume removing apparatus. None of the prior art toilet ventilating devices disclose the structure of the subject invention and the advantages thereof.

SUMMARY OF THE INVENTION

The subject invention is a free standing ventilating device which can be positioned adjacent any type and design of toilet bowl. The device can be quickly connected to the toilet by mounting an adjustable air intake arm between the top of the toilet bowl rim and the bottom of the toilet bowl seat. The air inlet arm is reversible so that it can be positioned on either side of the toilet bowl and is adjusted vertically in the housing of the device.

The device provides a removable filter disposed above an air blower for filtering the fumes from the toilet bowl.

The invention further includes a chamber disposed below the air intake port of the housing for receiving any water overflow which is received through the air intake arm. The water is received in the chamber and is discharged out the bottom of the housing by a floating ball valve seated in a ball seat. The water overflow chamber prevents water from contacting the charcoal filter and the electric air blower.

The free standing toilet stool ventilating device includes a housing having an air intake port disposed in the top of the housing and an air discharge port disposed in the bottom of the housing. A hollow air inlet arm is disposed at one end between the top of the toilet bowl and the bottom of the toilet seat with the other end of the air inlet arm pivotally attached to the air intake port of the housing. An electric blower is mounted inside the housing for drawing air from the air intake port and discharging it through the air discharge port. A filter is mounted in the housing and positioned above the blower for filtering the intake air. Disposed below and adjacent the air intake port of the housing is a water overflow chamber for receiving water from the air inlet arm when the toilet overflows. The water floats a floating ball resting in an open ball seat inside the chamber so that the overflow water flows through the ball seat and discharged out a water discharge port in the bottom of the housing.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
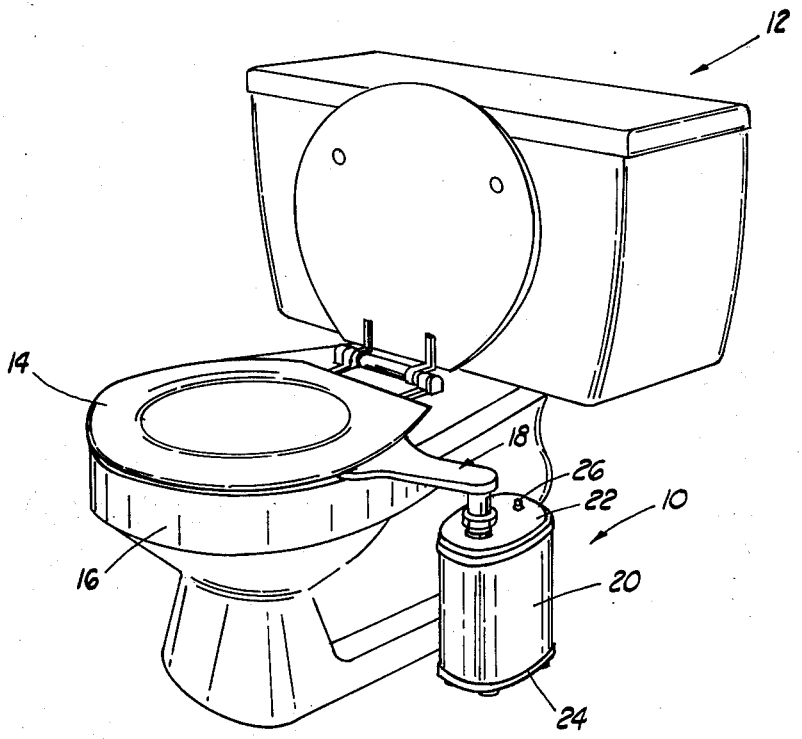
In FIG. 1, a perspective view of the free standing toilet stool ventilating device is illustrated positioned adjacent a toilet.

In FIG. 1, the free standing toilet stool device is designated by general reference numeral 10. The device 10 is positioned adjacent a toilet 12 having a toilet seat 14 and a toilet bowl 16. The device 10 includes an air inlet arm 18 pivotally attached to a device housing 20 having a removable housing top 22 and a removable housing stand 24. Extending upwardly from the housing top 22 is a push rod 26 which activates a switch inside the housing 20 for turing on and off a blower for removing fumes from the toilet bowl 16.

Figure 2:
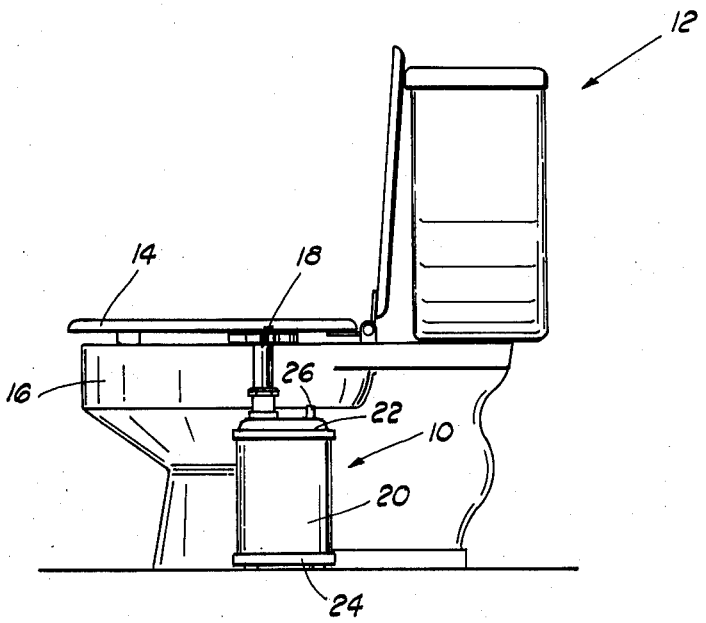
FIG. 2 is a side view of the toilet and device.
Figure 3:
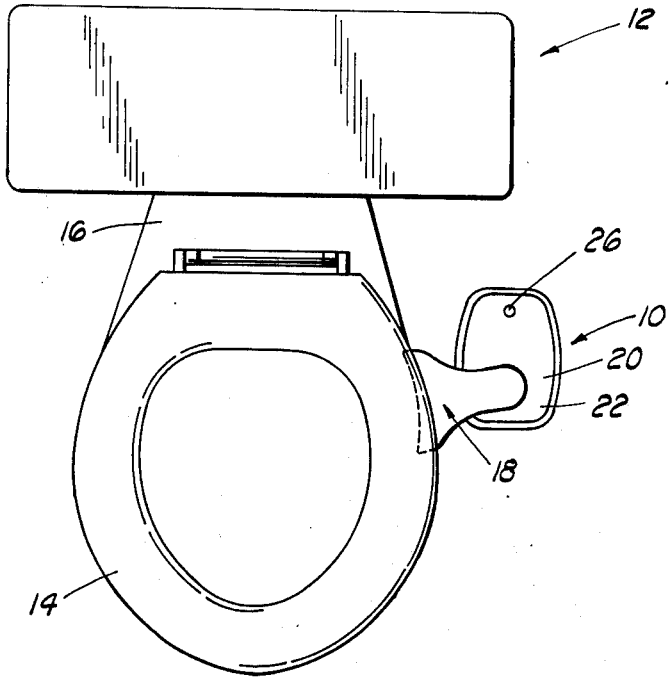
FIG. 3 is a top view of the toilet and device.

In FIG. 2, a side view of the device 10 is illustrated. In this view, the air inlet arm 18 can be seen disposed between the top of the bowl 16 and the bottom of the toilet seat 14. In FIG. 3, a top view of the device 10 is illustrated with one end of the air inlet arm 18 disposed underneath the toilet seat 14 and shown in dotted lines.

Figure 4A:
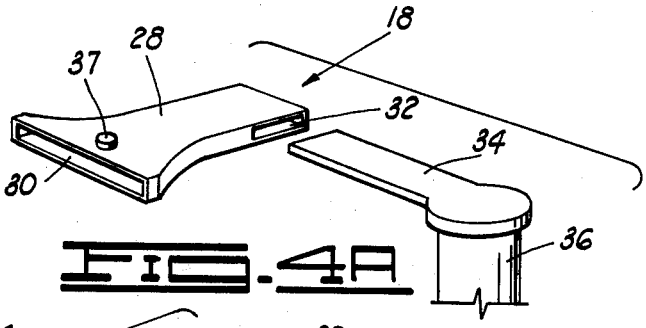
FIGS. 4A and 4B illustrates a reversible air inlet arm.
Figure 4B:
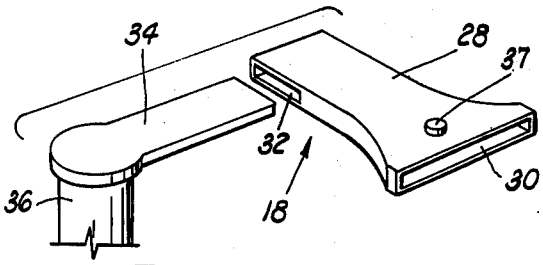

In FIG. 4A, and FIG. 4B, the hollow air inlet 18 is illustrated having a reversible hollow first end portion 28. The first end portion 28 includes an opening 30 which is positioned adjacent the side of the toilet bowl 16 for receiving fumes therefrom. The other end of the first end portion 28 includes an opening 32 in the side thereof for receiving one end of a hollow second end portion 34. The other end of the second end portion 34 is formed into an annular vertical arm 36. The annular vertical arm 36 is slidably received in the intake port of the housing 20. By turning the first end portion 28 upside down, the opening 32 can be positioned outwardly from the bowl 16 for slidably receiving the second end portion 34. By reversing the first end portion 28, the device 10 can be positioned on either side of the bowl 16.

The air inlet arm 18 further includes an annular stop 37 extending through the top and bottom of the first end portion 28 and extending outwardly therefrom. The stop 37 prevents the toilet seat 14 from compressing the first end portion 28 against the rim of the toilet bowl 16 thereby restricting the air flow through the first end portion 28.

Figure 5:
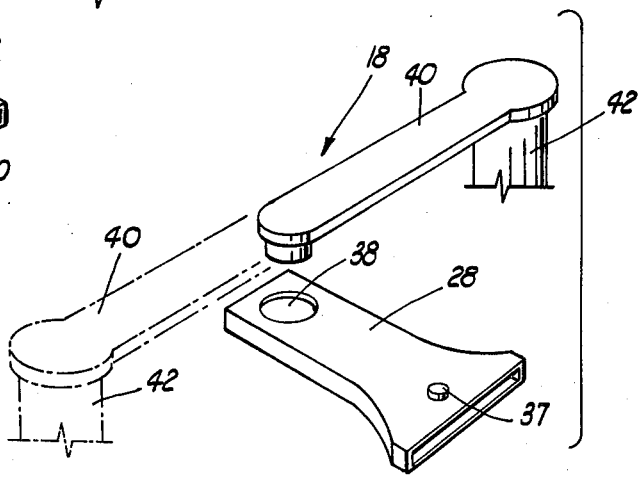
FIG. 5 illustrates an alternate embodiment of the air inlet arm.

In FIG. 5, an alternate embodiment of the air inlet arm 18 is shown wherein the first end portion 28 has an annular opening 38 in the top thereof for slidably receiving one end of a pivot arm 40. The other end of the pivot arm 40 includes an annular vertical arm 42 for inserting into the air intake port of the housing 20. By pivoting the pivot arm 40, 180° as shown in dotted lines, the air inlet arm 18 can be adjusted for mounting to either side of the bowl 16.

Figure 6:
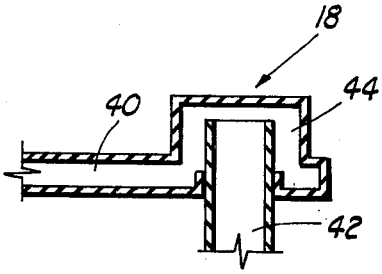
FIG. 6 illustrates another alternate embodiment of the air inlet arm.

In FIG. 6, another alternate embodiment of the air inlet arm 18 is illustrated in cross section wherein the pivot arm 40 includes an upwardly extending end portion 44 for receiving the annular vertical arm 42 therein. The top of the vertical arm 42 is extended above the plane of the hollow opening in the pivot arm 40. This feature protects the device 10 from receiving overflow water through the pivot arm 40, down the vertical arm 42 and into the housing 20.

Figure 7:
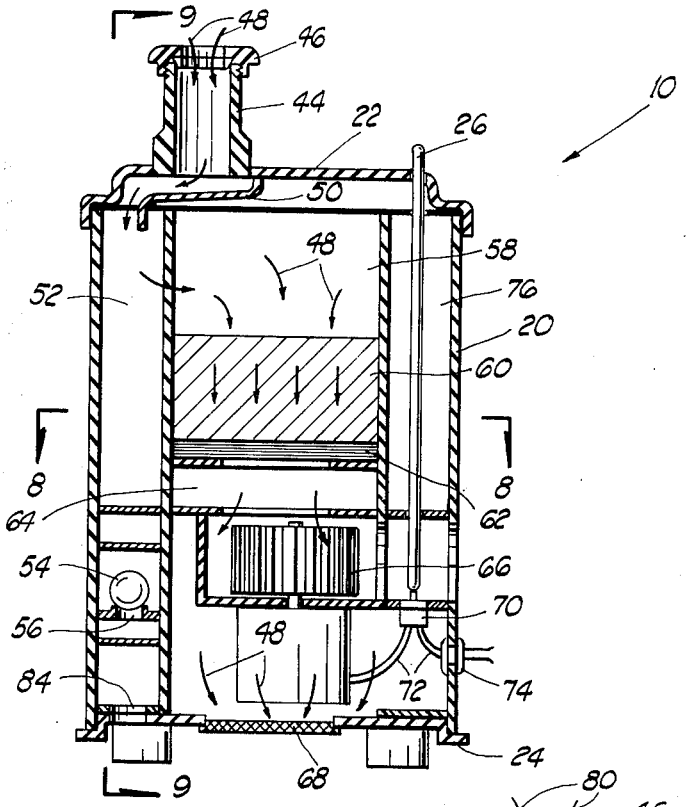
FIG. 7 illustrates a side cross sectional view of the housing of the ventilating device.

In FIG. 7, a side cross sectional view of the housing 20 is illustrated having the an air intake port 44 in the top of the housing 22 and having a threaded connector 46 for securing the annular vertical arm 36 or arm 42 therein. The inlet air is indicated by arrows 48 flowing through the housing 20. The removable housing top 22 of the housing 20 includes a lip portion 50 for deverting the air flow to above a separate water overflow chamber 52. The overflow chamber 52 includes a ball check valve 54 mounted on a hollow valve seat 56. The air flow is directed from the water overflow chamber 52 into a filter chamber 58 in the center of the housing 20. Positioned inside the filter chamber 58 is a removable charcoal filter 60. The charcoal filter 60 is mounted on top of a gasket 62. The gasket 62 is positioned above an air space 64. Below the air space 64 is mounted an electric blower 66 for drawing the air from the air intake port 44 through the water overflow chamber 52, into the filter chamber 58, and discharging it out an air discharge port 68 mounted in the bottom of the housing stand 24. The electric blower 66 is operated by a switch 70, which is positioned adjacent the blower 66 with the lower end of the push rod 26 resting on top of the switch 70. Wiring 72 is connected to the blower 66 and switch 80 and extends outwardly from a cord retainer 74. By pushing the push rod 26 vertically downward, the switch 70 is closed thereby activating the blower 60. By pushing the push rod 26 again, the switch 70 is opened thereby deactivating the blower 66.

Figure 8:
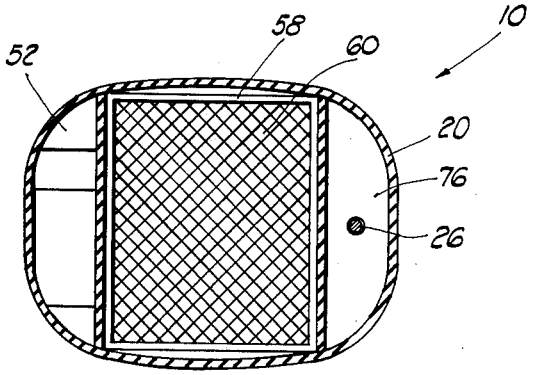
FIG. 8 is a top sectional view of the housing taken along lines 8—8 shown in FIG. 7.

In FIG. 8, a top cross sectional view of the housing 20 is illustrated taken along lines 8—8 shown in FIG. 7. In this view, a cross section of the removable charcoal filter 60 can be seen disposed in the filter chamber 58, and between a chamber 76 which houses the push rod 26, and on the opposite side the water overflow chamber 52, which houses the ball check valve 54.

Figure 9:
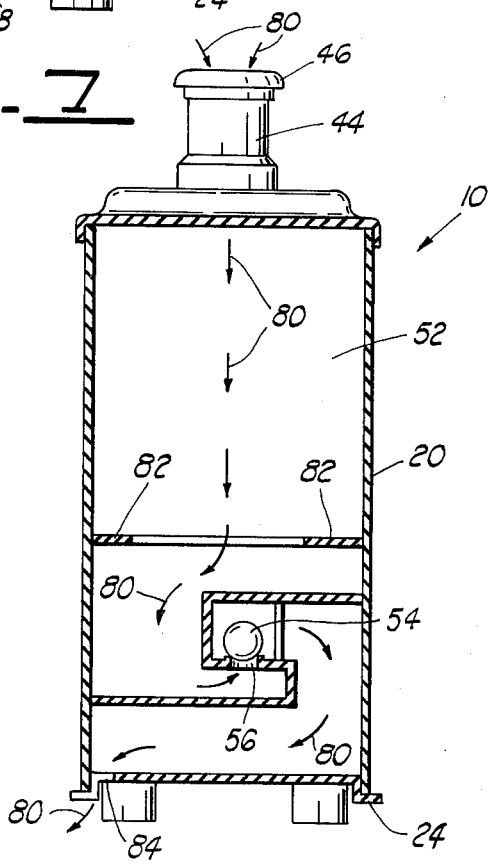
FIG. 9 is a front cross sectional view taken along lines 9—9 shown in FIG. 7.

In FIG. 9, a side cross section view of the housing 20 is illustrated taken along lines 9—9 shown in FIG. 7. In this view, the water overflow chamber 52 can be seen wherein arrows 80 illustrate water drawn into the water overflow chamber 52 circulated past support dividers 82 and underneath the ball check valve 56. As the water level increases, the ball check valve 56 floats upwardly allowing the water to pass through the valve seat 56 and out a water discharge port 84 in the bottom of the housing stand 24.

In operation, the device 10 is positioned adjacent the toilet bowl 16. The air inlet arm 18 is adjusted vertically by loosening the threaded connector 46 mounted on the air intake port 44 of the housing 20. The first end portion 28 of the arm 18 is placed underneath the toilet seat 14 and on top of the rim of the toilet bowl 16. The air inlet arm 18 is now tightened in place on the housing 20 by connector 46. The electric blower 66 is now connected to an electric outlet. The device 10 is activated by urging the push rod 26 in the housing 20 downwardly turning the switch 70 on thereby activating the electric blower 66. The fumes from the bowl 16 are drawn through the air inlet arm 18, into the arm intake port 44 in the top of the housing 20, and through the removable charcoal filter 60. The fumes are filtered and discharged out the air discharge port 68 at the bottom of the housing stand 24.

The device 10 includes the additional safety feature of having a water overflow chamber 52. Should the bowl 16 overlow and water circulate through the air inlet arm 18 and down through the air intake port 44 of the housing 20, the water is directed into a water overflow chamber 52. As the water builds up in the water overflow chamber 52, a ball check valve 54 is lifted and the water is directed through the valve seat 56 and out a water discharge port 84 in the bottom of the housing 20. By directing the water overflow through the water overflow chamber 52, water is prevented from contacting the removable charcoal filter 60 and the electric blower 66.

Changes may be made in the construction and arrangement of the parts or elements of the embodiment as disclosed herein without departing from the spirit or scope of the invention as defined in the following claims.

I claim:

1. A free standing toilet stool ventilating device for placing adjacent a toilet and ventilating fumes therefrom, the device comprising:

a housing having an air intake port disposed in the top thereof and an air discharge port disposed in the bottom thereof;

a hollow air inlet arm having one end disposable between the top of the toilet bowl and the bottom of the toilet seat, the other end of said air inlet arm pivotally attached to the air intake port of said housing;

an electric blower mounted in said housing for drawing air from the air intake port and discharging it through the air discharge port;

a filter mounted in said housing and positioned above the blower for filtering the intake air; and water overflow means mounted in said housing for receiving an overflow of water from the toilet through the air intake port and discharging the water out a water discharge port, thereby preventing the water from contacting said filter and said electric blower.

2. The device as described in claim 1, wherein said water overflow means is a separate chamber in said housing and positioned below the air intake port of said housing, said chamber including a floating ball valve resting in an open ball seat, said chamber receiving overflow water therein and floating said ball upwardly above said ball seat thereby allowing water to flow through said ball seat and discharged out said water discharge port.

3. The device as described in claim 2, further including a vertical push rod mounted in said housing and having on end extending outwardly from the top of said housing, the other end of said push rod extending downwardly in said housing and resting on an electric switch electrically wired to said blower, by urging said push rod downwardly, said switch is closed thereby activating said electric blower.

4. The device as described in claim 1, wherein said hollow air inlet arm includes a reversible first end portion slidably received in one end of a second end portion, said reversible first end portion mounted on either side of the toilet bowl, said second end portion pivotally attached to the air intake port of said housing.

5. The device as described in claim 1, wherein the other end of said hollow air inlet arm includes a vertical end portion slidably received in said air intake port and secured thereto by a threaded connection, by loosening said threaded connection, said air inlet arm may be adjusted vertically.

6. The device as described in claim 1, wherein said hollow air inlet arm includes a first end portion and a second end portion, one end of said second end portion pivotally mounted in the top of said first end portion, the other end of said second end portion pivotally attached to the air intake port of said housing.

7. A free standing toilet stool ventilating device for placing adjacent a toilet and ventilating fumes therefrom, the device comprising:

a housing having an air intake port disposed in the top thereof and an air discharge port disposed in the bottom thereof;

a hollow air inlet arm having one end horizontally disposable between the top of the toilet bowl and the bottom of the toilet seat, the other end of said arm vertically disposed and pivotally attached to the air intake port of said housing and threadably connected thereto;

an electric blower mounted in said housing for drawing intake air from the air intake port and discharging it through the air discharge port;

a removable charcoal filter mounted in said housing and positioned above the blower for filtering the intake air;

a water overflow chamber mounted in said housing and disposed below said air intake port for receiving overflow water from the toilet through the intake port, said chamber including a floating ball resting in an open ball seat, the overflow water floating said ball above the seat and flowing therethrough into a water discharge port mounted at the bottom of said housing; and a vertical push rod having one end extending upwardly through an aperture in the top of said housing, the other end of said push rod resting on top of an electric switch, said switch electrically wired to said electric blower, by pushing said push rod, said switch is turned on and off for activating said electric blower.

8. The device as described in claim 7, wherein said air inlet arm is reversible so that the device may be positioned adjacent either side of the toilet bowl.

9. The device as described in claim 7, wherein said hollow air inlet arm includes a horizontal first end portion disposable between the toilet bowl and toilet seat and a vertical second end portion pivotally attached to the air intake port of said housing, the top of said second end portion extending above the horizontal plane of said first end portion to prevent water from flowing down said second end portion when water backs up in said air inlet arm from the toilet bowl.

* * * * *

UNITED STATES PATENT OFFICE

CERTIFICATE OF CORRECTION

Patent No. 4,059,857 Dated November 29, 1977

Inventor(s) Clarence E. Poister

It is certified that error appears in the above-identified patent and that said Letters Patent are hereby corrected as shown below:

Column 1, line 10, delete "to" and add --- of ---.
Column 1, line 11, after the word "bowl", add --- , or for mounting adjacent the rim of the toilet bowl, ---.
Column 2, line 24, correct the spelling of the word "turning".
Column 2, line 32, after the word "inlet", add --- arm ---.
Column 3, line 6, after the word "having", delete --- the ---.
Column 3, line 64, delete "arm" and add --- air ---.

Claim 3, column 4, line 51, delete "2" and add --- 1 ---.

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*